US008677799B2

(12) United States Patent
Jamet

(10) Patent No.: US 8,677,799 B2
(45) Date of Patent: Mar. 25, 2014

(54) APPARATUS FOR HYDRAULICALLY ACTUATING PROCESSING MACHINES SUCH AS METAL FORMING MACHINES AND METHOD FOR ACTUATING SUCH METAL FORMING MACHINES

(75) Inventor: Frédéric Jamet, Le Perreux sur Marne (FR)

(73) Assignee: Oilgear Towler S.A.S., Croissy Beaubourg (FR)

( * ) Notice: Subject to any disclaimer, the term of this patent is extended or adjusted under 35 U.S.C. 154(b) by 606 days.

(21) Appl. No.: 12/999,661

(22) PCT Filed: Jul. 27, 2009

(86) PCT No.: PCT/EP2009/005424

§ 371 (c)(1),
(2), (4) Date: Dec. 17, 2010

(87) PCT Pub. No.: WO2010/124708

PCT Pub. Date: Nov. 4, 2010

(65) Prior Publication Data

US 2011/0094280 A1 Apr. 28, 2011

(51) Int. Cl.
*B21J 9/18* (2006.01)

(52) U.S. Cl.
USPC ... 72/453.06; 72/28.1; 72/453.02; 72/453.08; 100/269.08; 100/269.1; 100/269.14

(58) Field of Classification Search
USPC ..... 72/17.2, 20.1, 28.1, 453.01, 453.02, 72/453.03, 453.06, 453.07, 453.08, 72/453.18; 100/269.06, 269.08, 269.09, 100/269.1, 269.14
See application file for complete search history.

(56) References Cited

U.S. PATENT DOCUMENTS

| | | | | |
|---|---|---|---|---|
| 2,745,366 | A * | 5/1956 | Japikse | 72/1 |
| 3,046,923 | A * | 7/1962 | Yolin | 72/28.1 |
| 5,158,723 | A * | 10/1992 | Walchhutter et al. | 264/40.5 |
| 5,499,525 | A * | 3/1996 | Kordak et al. | 72/453.03 |
| 6,520,075 | B1 * | 2/2003 | Shinoda et al. | 100/214 |
| 6,941,783 | B2 * | 9/2005 | Yamanaka et al. | 72/17.2 |

FOREIGN PATENT DOCUMENTS

| | | |
|---|---|---|
| DE | 1 502 282 | 3/1969 |
| DE | 2 223 709 | 12/1973 |
| DE | 33 26 690 A1 | 2/1985 |
| DE | 43 45 339 C2 | 10/1997 |
| EP | 0 654 330 A1 | 5/1995 |
| JP | 2002-130201 | 5/2002 |

* cited by examiner

*Primary Examiner* — Edward Tolan
(74) *Attorney, Agent, or Firm* — Antonelli, Terry, Stout & Kraus, LLP.

(57) ABSTRACT

The invention relates to an apparatus for actuating of processing machines like metal forming machines and method, control and application of an apparatus for actuating said metal forming machines. The processing machine is driven by at least two rams with pressurized fluid, like water, whereas the rams are actuated by variable pumps with different fluid under pressure, e.g. hydraulic liquid.

22 Claims, 4 Drawing Sheets

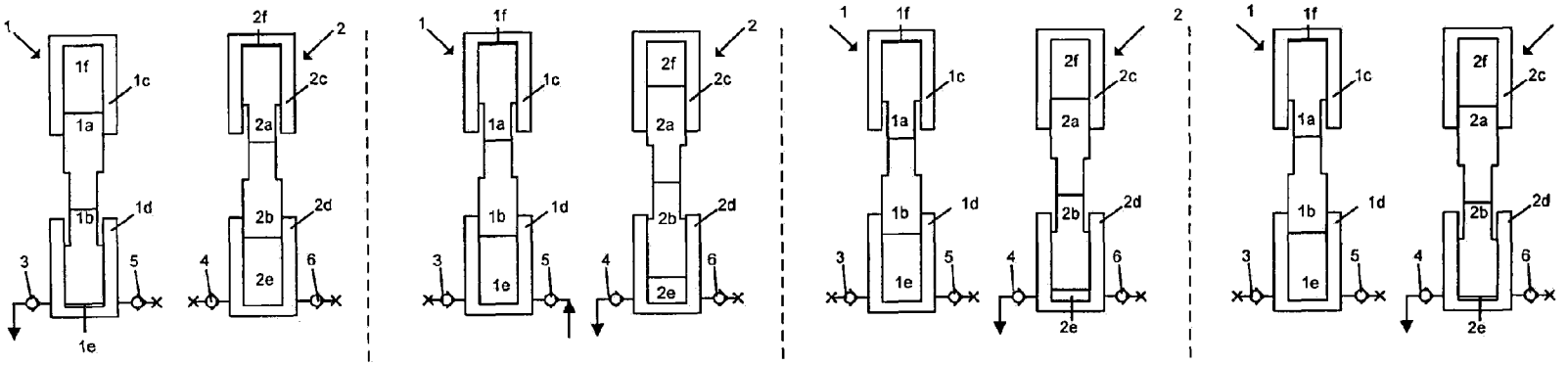
Fig. 2a
Fig. 2b
Fig. 2c
Fig. 2d
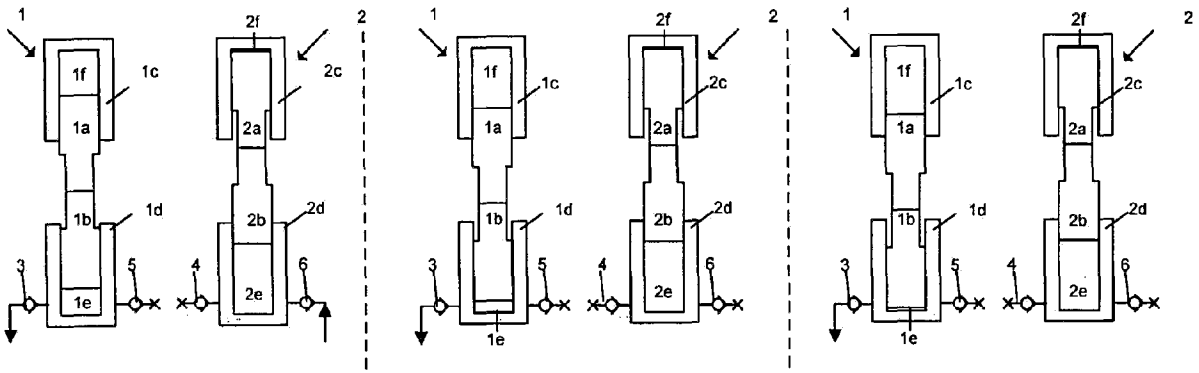
Fig. 2e
Fig. 2f
Fig. 2g

APPARATUS FOR HYDRAULICALLY ACTUATING PROCESSING MACHINES SUCH AS METAL FORMING MACHINES AND METHOD FOR ACTUATING SUCH METAL FORMING MACHINES

The invention relates to an apparatus for actuating of processing machines such as forging presses, extrusion presses, forging hammers, steel working machines, milling machines or other metal forming machines.

Another object of the invention is to create a suitable application of such an apparatus.

The invention also relates to a method for metal forming machines.

Still another object is to suggest a control for such metal forming machines like forging presses or the like using an apparatus according to the invention.

Metal working machines like forging presses, forging hammers, extrusion presses, steel working machines, milling machines are well-known. DE 33 26 690 C2 describes an apparatus for actuating a hydraulic forging press with several variable flow generators of pressure. Those generators receive hydraulic fluid by a boost pump from a source via a check valve.

DE 1 502 282 describes a forging press with a hydraulic actuator and accumulators.

Also the forging press according to DE 2 223 709 works with accumulators via distribution valves.

Summarizing, some of the hydraulic machines works with High Water Based Fluids (HWBF) or even pure water. Those fluids are very aggressive and cannot be pumped by any type of pumps. The most common solution to handle those fluids is to use fixed delivery reciprocating pumps, e.g. triplex or quintuplex pumps, delivering into hydraulic accumulators which then restitute their energy to the system through proportional valves. The fact that this type of pump delivers a fixed flow prevents its use to drive directly the hydraulic cylinders of the machines which need different speeds according to the sequences of their cycles (approach phase, working phase, return phase).

The main disadvantages of those hydraulic machines with motors driven fixed delivery pumps, hydraulic accumulators, proportional valves and hydraulic cylinders are the following:

- the use of reciprocating pumps
- the use of hydraulic accumulators which require safety components to secure the system
- the accumulators need to be certified regularly by competent authorities
- the tremendous energy stored in the accumulators has to be controlled by proportional valves which generate heat, waste power and wear the components by erosion.

The principles of the fixed delivery reciprocating pumps are:

An electric motor shaft goes into a gearbox to reduce its rotational speed. The outlet shaft of the reduction box drives a cam shaft to transform the rotational movement into a linear movement transmitted to a certain number of cylinders (3 or 5 usually). The bodies of the cylinders hold an inlet check valve and an outlet check valve. During one complete turn of the cam shaft, the piston of the cylinder makes a backward movement admitting the pumped fluid into the cylinder from the inlet check valve and then a forward movement to deliver the fluid through the outlet check valve.

The main disadvantages of these reciprocating pumps are:

- only a fixed flow delivered
- flow/pressure pulsations on the delivery port/pressure pipe or channel

- the alternate loads on camshafts drive to fatigue failures
- important maintenance costs
- unnecessary power consumption due to mechanical frictions.

The object of the invention is to overcome these disadvantages.

One object of the invention is to offer an apparatus for actuating of processing machines, such as presses, forging presses, extrusion presses, forging hammers, steel working machines, milling machines or other metal forming machines, by means of fluid pressurizing media.

Another object of the invention is to suggest an application of an apparatus according to the invention.

Another object of the invention is to suggest a method for those metal forming machines.

Still another object of the invention is to offer a control of those metal forming machines.

Still another object of the invention is to offer a metal forming machine as described above.

The solution of the first object is described in any of claims 1 to 5, independently.

An apparatus for actuating of processing machines like metal forming machines as described above contain at least one variable delivery pump or more than one variable delivery pump, which pump via at least one distribution valve or several distribution valves the fluid, for example mineral oil, directly into the cylinder rooms of hydrostatic generators or hydrostatic actuators (rams).

The pressure of the fluid delivered by the variable pumps can be up to 500 bar, preferably up to 350 bar. The sealed pistons of the generators or actuators are each connected via separate piston rods to another piston which is movable in a separate or the same cylinder, also in a sealed manner. Separate cylinder rooms receive via different pipes or channels from a fluid or water boost supply separately a specific amount of fluid or liquid which is being compressed by the movable pistons working in opposite arranged cylinders. The circuit for this fluid or liquids like water is completely separated from a supply circuit which delivers a fluid, for example hydraulic oil, to the opposite arranged cylinder rooms of the rams. One of the pair of pistons or rams goes up, the other pair of pistons goes down and vice versa. Both generators or actuators or rams deliver fluid, especially water based fluids or pure water, into a pipe or channel system, which is connected to the metal forming machine, like a forging press or the like. The frequency or pulsation in the pressure line is very small and smooth, almost equal. There could be also more than two, for example four or even more generators or actuators or rams which work altogether and deliver liquids or fluid under high pressure to the pipe or channel to the system which leads to the metal forming machine.

The main advantages of such an apparatus or machineries are:

- the use of variable pumps
- simplification of the circuit by using logic valves (opened or closed, no proportionality)
- a lower power consumption because the rams deliver only when it is needed and has a better efficiency In one aspect of the invention, the invention may comprise an apparatus with at least two separated e.g. hydrostatic generators or pressure actuators or rams with at least one distribution valve and a motor-driven pump that is variable with regard to its flow rate.

In another aspect of the invention, the invention may comprise an apparatus for actuating processing machines with multiple motor-driven pumps, which are all variable with regard to their flow rate with at least two separated e.g. hydrostatic pressure generators or e.g. hydrostatic actuators.

In another aspect of the invention, the invention may comprise an apparatus for actuating such processing machines with a motor driven pump that is variable with regard to its flow rate and at least two separated e.g. hydrostatic pressure generators or hydrostatic actuators, wherein the pipe or channel system of the pressure pipe or channel which leads to the metal forming machine is completely separated from the pipe or channel system which is connected to the motor driven pump or pumps.

In another aspect of the invention, the invention may comprise multiple motor driven pumps which are variable with regard to their flow rate deliver hydraulic liquid, hydraulic oil, emulsion or the like and pump it into the separated or in the collective pressurizing medium pipes or channels, whereas the pressurizing medium pipe or channel coming from the variable pumps can be connected to each of the pressure generators or actuators via interconnection of distribution valves, and whereby the pressure generators or actuators deliver a different pressurizing medium in a separate pressurizing media pipe or channel system for the purpose of actuating the allocated processing machine, whereas the pressurizing medium is different from the fluid, for example, hydraulic oil, delivered by the variable pumps for actuating the pressure generators or actuators (rams).

In another aspect of the invention, the invention may comprise an apparatus for actuating of processing machines with one or multiple motor driven pumps that are variable with regard to their flow rate, which actuates at least two alternately driven pressure generators or actuators. The fluid which is delivered by the variable motor driven pumps is different from the fluid which is compressed by the generators or actuators, for example pure water or high water based fluid.

The application of an apparatus according to any of the embodiments detailed herein, or arrangements or combinations thereof, provides special advantages in connection with metal forming machines like forging presses or the like.

The foregoing and other objects and advantages of the invention will appear in the detailed description which follows. In the description, reference is made to the accompanying drawings which illustrate a preferred embodiment of the invention as examples. Many modifications and variations will be apparent to those skilled in the art. Therefore, the invention should not be limited to the embodiment described, but should be defined by the claims.

One embodiment of the invention is described, by way of example, with reference to the accompanying drawings, in which:

FIG. 1 is a schematic plan view according to the invention;

FIG. 2*a*-2*g* show step by step the movements of the cylinders during a cycle of the apparatus to bring a complete understanding of the principle:

FIG. 2*a* Step 1—Beginning of the cycle; generator is delivering pressurized fluid to the system through outlet check valve; inlet check valve is closed; generator is precompressed; the pressures are enclosed in the cylinders; piston is ready to deliver fluid to the system; check valves are closed;

FIG. 2*b* Step 2—Generator has been filled with the fluid through inlet check valve still opened; check valve is closed; generator is delivering pressurized fluid to the system through outlet check valve; inlet check valve is closed;

FIG. 2*c* Step 3—Generator is ready for precompression; check valves are closed; generator is still delivering pressurized fluid to the system through outlet check valve; inlet check valve is closed;

FIG. 2*d* Step 4—Generator is precompressed; the pressures are enclosed in the cylinders; piston is ready to deliver fluid to the system; check valves are closed; generator is delivering pressurized fluid to the system through outlet check valve; inlet check valve is closed;

FIG. 2*e* Step 5—Generator is delivering pressurized fluid to the system through outlet check valve; inlet check valve is closed; generator has been filled with the fluid through inlet check valve still opened; check valve is closed;

FIG. 2*f* Step 6—Generator is still delivering pressurized fluid to the system through outlet check valve; inlet check valve is closed; generator is ready for precompression; check valves are closed;

FIG. 2*g* Step 7—End of the cycle—Generator is delivering pressurized fluid to the system through outlet check valve; inlet check valve is closed; generator is precompressed; the pressures are enclosed in the cylinders; piston is ready to deliver fluid to the system; check valves are closed; the position is identical to the position of FIG. 2*a;*

Figure 1:
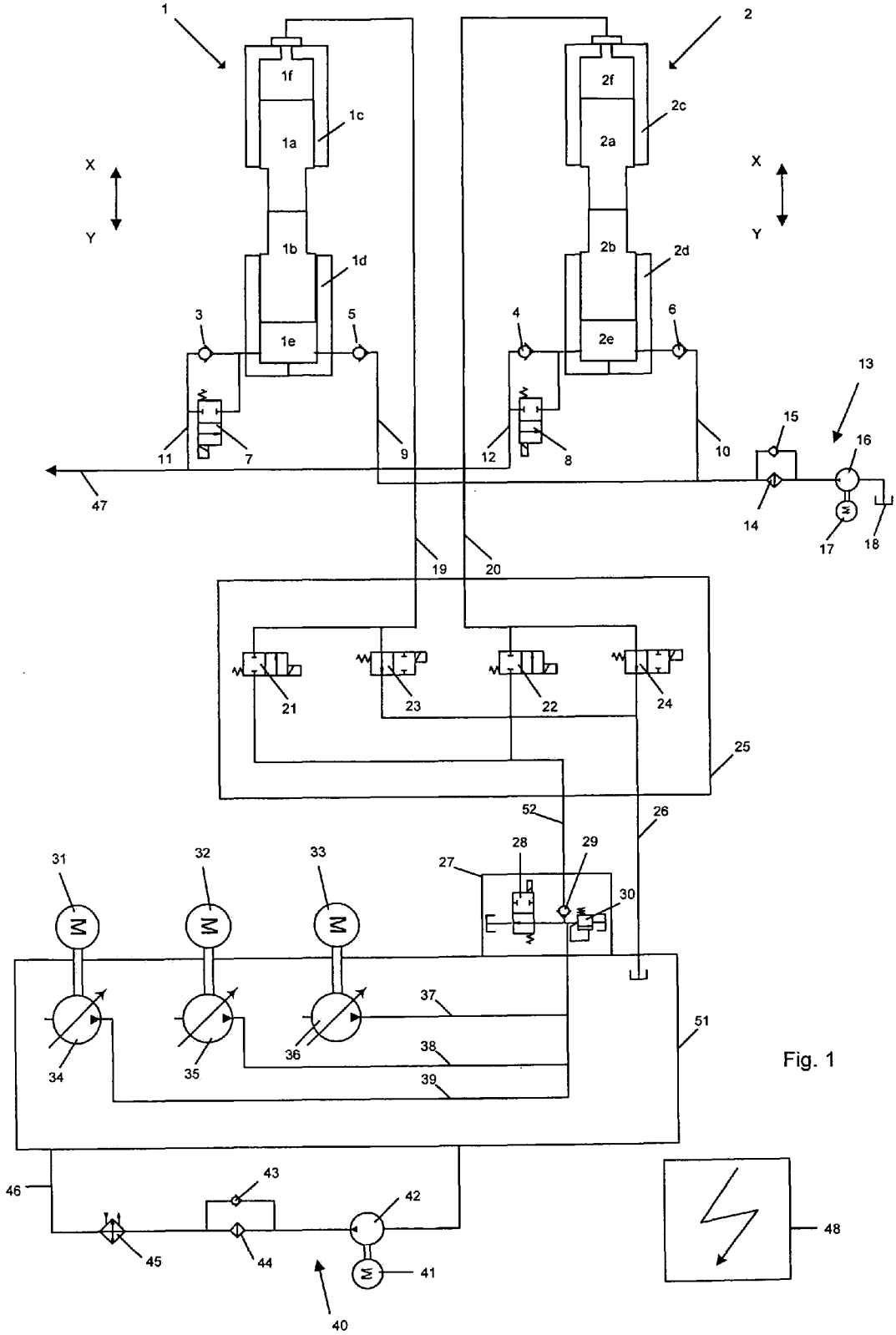

In FIGS. 1 and 2 hydrostatic pressure generators or hydrostatic actuators (rams) are marked with the references 1 and 2, each of which consist of two pistons 1*a*, 1*b* or 2*a*, 2*b* coaxially arranged to each other.

The pistons 1*a*, 1*b* or 2*a*, 2*b* are axially movable in the directions X or Y in a sealed manner in cylinders 1*c*, 1*d* or 2*c*, 2*d*. The cylinders 1*c*, 1*d* or 2*c*, 2*d* may also be connected with each other to build one cylinder part, each of which contains the cylinders 1*c*, 1*d* or 2*c*, 2*d*.

The pistons 1*a*, 1*b* and 2*a*, 2*b* and their cylinders 1*c*, 1*d* and 2*c*, 2*d* have the same size and same diameter in the shown embodiment. But it should be clear that the pressure active surfaces of the pistons 1*a*, 1*b* and 2*a*, 2*b* may be identical or different in size.

It is also clear for one skilled in the art that the pressure active surfaces of the pistons 1*b*, 2*b* may be greater or smaller than the pressure active surfaces of the pistons 1*a*, 2*a* to get higher or lower pressures, respectively, at the pressure side of the rams 1 and 2.

It should be also clear that because of simplicity, in the drawings are shown two hydraulic generators or actuators 1, 2 (rams), but there could be also one or more than two, for example four or six or even a greater number of generators or actuators 1, 2 (rams) than shown in the drawings.

The pressure generators 1, 2 may be arranged vertically with their longitudinal axes. In the drawings these axes in which the pistons 1*a*, 1*b* and 2*a*, 2*b* can move in the direction X or Y are parallel, but there are also solutions possible, in which the cylinders may be arranged in a different position, for example horizontally or inclined to each other should this be necessary.

It is also clear for one skilled in the art that the pressure generators 1, 2 must not be close together. One or more than one generator may be arranged from the other generators in a distance, for example in a different room without changing the function which will be described in more details now.

Above piston 1*a* and below piston 1*b* are cylinder rooms 1*f* and 2*f* and above piston 2*a* and below piston 2*b* are cylinder rooms 1*e* and 2*e*.

Cylinder rooms 1*f* and 2*f* are each connected to a pipe or channel 19 and 20 which are connected to a control manifold 25 with two admission or distribution valves (21, 22) and two exhaust valves 23, 24 each actuated by a solenoid which is controlled by the automation cubicle 48. These valves 21, 22, 23 and 24 may be connected to lading manifold 27. Pipe 52 leads to a pumping station with three pumps 34, 35 and 36 which are variable with regard to their flow rate. Each pump 34, 35, 36 is motor-driven by a suitable motor, for example an electrical motor 31, 32 and 33. Each pump 34, 35, 36 may be controllable in regard of their flow rate by the automation cubicle 48. The pumps 34, 35 and 36 may be controlled in view of their flow rate separately or all together at the same time. There could be also more than three or less than three pumps, for example four pumps, all variable to their flow rates, if necessary. Preferably all pumps 34, 35 and 36 are equally build and may produce the same flow rate during a specific time limit if they got the same control input.

The pumping station is equipped with a filtration and cooling loop 40 for the fluid which is pumped by the pump 42 and delivered through the pipe 46. This fluid can be preferably a hydraulic liquid like hydraulic oil or emulsion. The filtration and cooling loop 40 contains a motor 41, a pump 42, a filter element 44 with a bypass check valve 43, and a cooling station 45. The reservoir 51 of the pumping station may contain a suitable amount of fluid, e.g. hydraulic oil.

The pressure lines or pressure pipes 37, 38, 39 of the three pumps 34, 35, 36 are interconnected to the loading manifold 27. Whereas in FIG. 1 all three pumps 34, 35, 36 are connected via branch pipes or channels 37, 38 and 39 to the single loading manifold 27 it is also possible to connect the pressure pipes or channels of each three pumps 34, 35 and 36 to separated loading manifold like manifold 27.

The loading manifold 27 has an electrically controlled valve 28, a check valve 29 and a pressure limiter 30.

Pipe 26 leads to the suitable container or reservoir 51 to store backflow fluid from the hydrostatic generators or actuators 1 and 2.

Reference 13 is a filtered water boost supply with a filter 14 with bypass check valve 15, motor 17, which drives the pump 16 and a hydraulic fluid source 18.

Cylinder room 1*e* is connected via a pipe or channel 11 and an outlet check valve 3 to a pressure line or channel 47 which leads to the processing machine, for example a forging press, which has to be driven by the hydraulic generators or actuators 1 and 2. Reference 7 shows a precompression valve with a solenoid which allows to bypass the check valve 3 when operated in order to precompress the cylinder room 1*e*.

Cylinder room 2*e* is connected to a pipe or channel 12 via a check valve 4 also to pressure line 47. Reference 8 shows a precompression valve with a solenoid which allows to bypass the check valve 4 when operated in order to precompress the cylinder room 2*e*.

Both cylinder rooms 1*e* and 2*e* are connected via inlet check valves 5 and 6 to a pipe or channel 9 or 10, respectively, which is connected to the filtered water boost supply 13.

In the embodiment shown in the drawings the pipework or channel work system build by pressure line 47, pipes 11, 12, 9, 10 and the water boost supply 13 is separated from the pipe system or channel which is mainly build by pipes 19, 20, 26, 52.

The filtered water boost supply 13 delivers in the shown example pure water to cylinder rooms 1*e* and 2*e* alternately, whereas the pumps 34, 35 and 36 deliver a hydraulic fluid, like hydraulic oil or emulsion via admission and exhaust valves 21, 22, 23, 24 alternately to the cylinder rooms 1*f* and 2*f* of the hydrostatic pressure generators or actuators 1 and 2.

Therefore, both fluids which fill the cylinder rooms 1*f* and 2*f* and 1*e* and 2*e* can be completely different. Whereas in the cylinder rooms 1*e* and 2*e* can be pure water, the fluid which is pressed into the cylinder rooms 1*f* and 2*f* can be hydraulic oil or emulsion. The fluid, e.g. water, which fills the cylinder rooms 1*e* and 2*e* under pressure moves the pistons 1*a*, 1*b* or 2*a*, 2*b* in the direction X alternately, whereas the fluid, e.g. hydraulic liquid, which is delivered through pipes 19 and 20 into the cylinder rooms 1*f* and 2*f* drives the pistons 1*a*, 1*b* or 2*a*, 2*b* into the direction Y and actuates a processing machine, like a forging press by fluid under high pressure through pressure pipe or channel 47.

The fluid like water which is pumped by the filtered water boost supply 13 into pipes 9 and 10, respectively, could be under pressures from 1 to 15 bars, preferably 4 bar, whereas the pressures delivered by the pumps 34, 35, 36 through pipes 26, 52 could be up to 500 bar, preferably up to 350 bar.

The pressures of the fluids or liquids in pipe 47 could be up to 1400 bars, depending on the processing machine which has to be driven by the apparatus according the invention.

Figure 3:
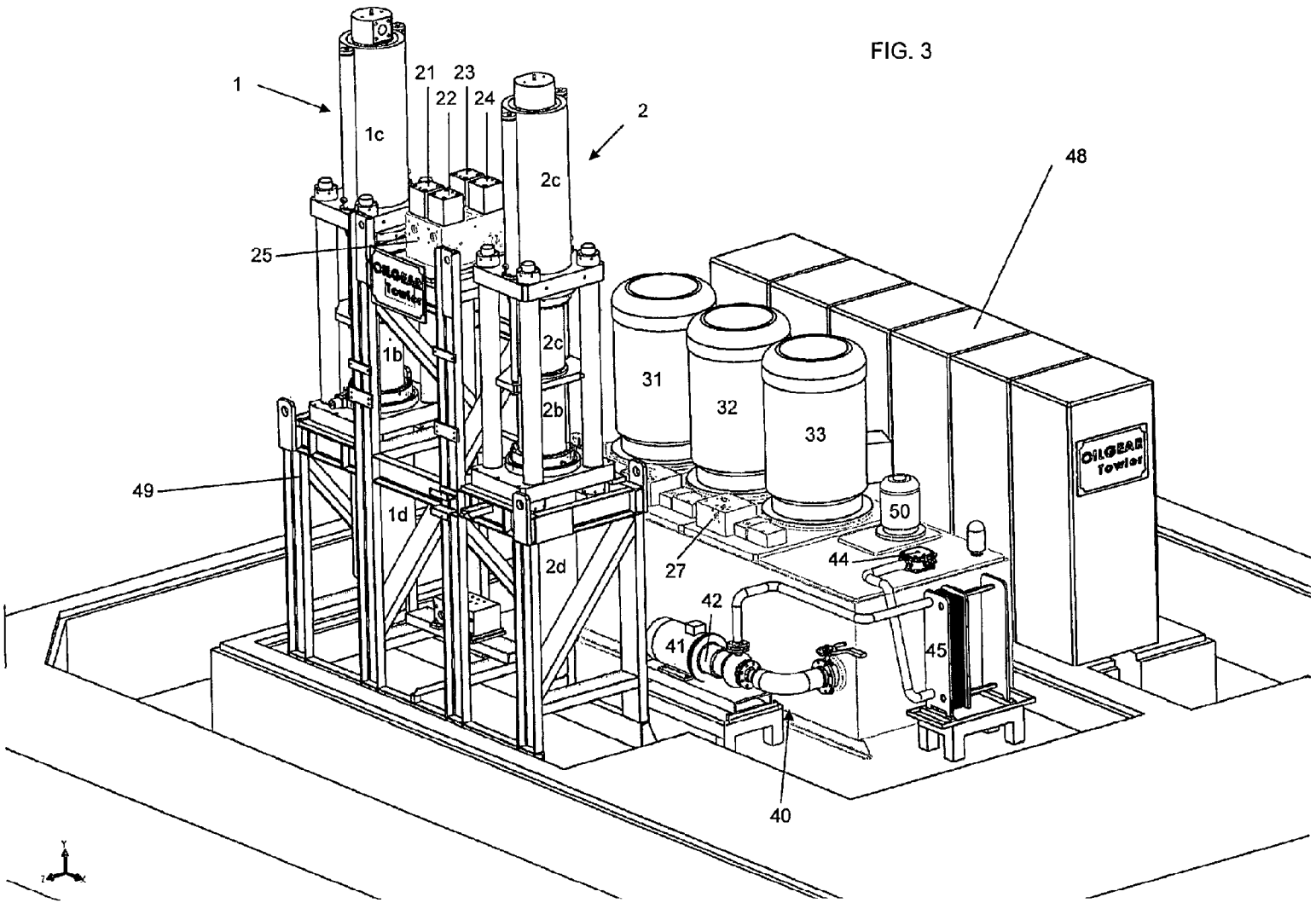
FIG. 3 shows an apparatus for actuating processing machines, such as extrusion presses, forging presses, forging hammers, steel working machines, milling machines or the like, in three-dimensional view.

In FIG. 3 the items are marked with the same references as used in FIG. 1. Reference 48 are a power supply and automation control cabinets which controls the motors 31, 32, 33 and the pumps 34, 35, 36 and all valves like 21, 22, 23, 24, 7, 8 and 28 and the motor 17 for the pump 16 of the boost supply 13. The two rams or hydrostatic generators 1 and 2 are vertically positioned and their longitudinal axes are parallel to each other. The processing machine which receives the pressurized fluid from the two rams 1 and 2 is not shown.

The piston or ram stroke of pistons 1*a*, 1*b* or 2*a*, 2*b*, respectively are each of one meter. The full cycle time of each ram stroke is around eight seconds, that is to say four seconds to pump, three seconds to return and 0.5 second to close the inlet check valve 5 or 6, 0.5 seconds to precompress the fluid.

The speed of the pistons 1*a*, 1*b* or 2*a*, 2*b* during their pumping and returning stroke is almost constant, with the exception for the short acceleration and deceleration periods at the beginning and at the end of the stroke, and has values respectively of about 250 mm/sec and 330 mm/sec. This is ten times less than the average speed of a triplex pump and more than fifteen times less than its maximum speed.

In the shown embodiment in FIG. 3 each pair of pistons 1*a*, 1*b* or 2*a*, 2*b* moves a distance of 15 meters every minute. This is ten times less than of a triplex pump. The life of the seals and the wear of the contact surfaces are considerably better.

The control of the shown apparatus on return saves 0.5 seconds to allow for the natural closing of the inlet check valve 5 or 6 by its spring. There is no back flow under pressure through the inlet valve 5 or 6 and thus its overall efficiency gains when compared to the triplex pump.

The pistons 1*a*, 1*b* or 2*a*, 2*b* performs 7.5 cycles per minute in the shown embodiment. Each inlet and outlet check valve 5, 6 or 3, 4 then operates 7.5 times per minute compared with around 300 openings/closings per minute for a triplex pump check valves.

The apparatus shown in FIG. 1 can also operate as a variable pump, pressure or volume control and when flow is not required the rams or generators 1*a*, 1*b* are stationary.

The variable pumps 34, 35, 36 have the advantage that the required flows can be given for each function of the processing machine directly to the cylinders 1*c*, 1*d* of the pressure generators 1 or 2. In consequence the pressure generators 1 or 2 will deliver the necessary flows to control the speed of the processing machine in each of its phases (approach, working phase, return).

In comparison triplex pumps on water systems, those fixed delivery triplex pumps fill high pressure accumulators. These accumulators give their flow to the hydraulic system through proportional throttling valves to control the speeds of the actuators thus:

generating heat
wasting power
wearing components by erosion
generating dirt particles The vertical mounting of the generators or rams 1, 2 allows the on top mounted seals to work in the best conditions: concentricity and dirt particles at the bottom (far from the seals).

The overall efficiency of an apparatus according to the invention is better than on mechanically driven pumps (less power consumption).

An apparatus shown in FIG. 1 and FIG. 3 can be sized easily and then can work at various levels of pressure between (for example) 250 up to 1400 bar, preferably between 250 and 450 bar or 250 and 850 bar, and with various fluids, like pure water (for the rams and generators), hydraulic oil or emulsion, or the like.

An apparatus shown in FIGS. 1 and 3 is made of several components, most of them are available on the market and generally with several motor-pump groups. If one group is out of order, the apparatus shown in FIG. 1 and FIG. 3 can still work with lower performance, especially if there are more than two rams or generators 1 and 2, for example four or six of such rams 1 and 2.

The pressure generators 1 and 2 produce a very steady and uniform flow with just minor pulsations in the fluid pressure in the pressure pipe or channel 47. There is almost no pumping effect.

FIG. 2*a*-2*g* show a typical cycle of pistons 1*a*, 1*b*, 2*a*, 2*b* of the hydrostatic generators or rams 1 and 2.

In FIG. 2*a* piston 1*b* is in its lowermost position, whereas piston 2*a* is in its uppermost position. The cylinder room 2*e* is in its precompression position in which fluid, for example pure water coming from the pipe 12, is delivered through the precompression valve 8 in cylinder room 2*e*, whereas piston 2*b* delivers high pressure by starting its movement in direction Y (down).

FIG. 2*b* shows the same rams or generators 1 and 2 after three seconds starting their movement in FIG. 2*a*. Cylinder room 1*e* is filled with water through check valve 5 which is closing. From cylinder room 2*e* fluid under high pressure is delivered into the pressure pipe 47 by movement of cylinder 2*b* in its down position through check valve 4.

FIG. 2*c* is an intermediate position after 3.5 seconds starting in FIG. 2*a*. Check valve 5 is closed. From cylinder room 2*e* fluid under high pressure is delivered into the pressure pipe 47 through check valve 4.

FIG. 2*d* shows a position after four seconds from the position in FIG. 2*a*. Piston 2*b* is in its completely down position and delivers fluid under high pressure through check valve 4 into pipe 47, whereas the cylinder room 1*e* is in its precompression position in which fluid comes from the pipe 11, is delivered through the precompression valve 7 in cylinder room 1*e*.

FIG. 2*e* is the situation after seven seconds starting from position FIG. 2*a*. From cylinder room 1*e* fluid under high pressure is delivered via check valve 3 into pressure pipe 47 and piston 2*b* in cylinder room 2*e* is moving in direction Y by prefilling with fluid, for example, pure water.

FIG. 2*f* shows the generators or rams after 7.5 seconds from FIG. 2*a*. Cylinder 1*d* delivers fluid, for example pure water, by a check valve 3 into the pressure pipe 47 under high pressure, whereas inlet check valve 6 is closing and piston 2*b* was moved in direction Y completely.

FIG. 2*g* is the situation after eight seconds from position 2*a*. Piston 1*b* is completely down moved in direction Y and the cylinder room 2*e* is precompressed by the opening of the valve 8. Piston 2*b* is ready to press the fluid under high pressure via a check valve 4 into the pipe 47.

The cylinder rooms if and 2*f* during the cycles described in connection with FIG. 2*a*-2*g* are filled with fluid alternately, during the cycles with a different fluid or liquid, for example hydraulic oil via the distribution valves 21, 23, 22, 24 by the action of the variable pumps 34, 35 and 36, controlled by a suitable electronic and/or electrical control system 48.

From the foregoing description it is clear that rams or generators 1 and 2 move at all times in opposite directions to each other. For example, if piston 1*a*, 1*b* is moving in direction Y, at the same time piston 2*a*, 2*b* is moving in direction X and vice versa.

High pressure channel 47 leads to a loading manifold 57 via a check valve 59 to a distribution or several ways or distribution valve 63, whereas reference 58 shows a loading valve. Valve 60 and reference 58 is a pressure relief valve.

Figure 4:
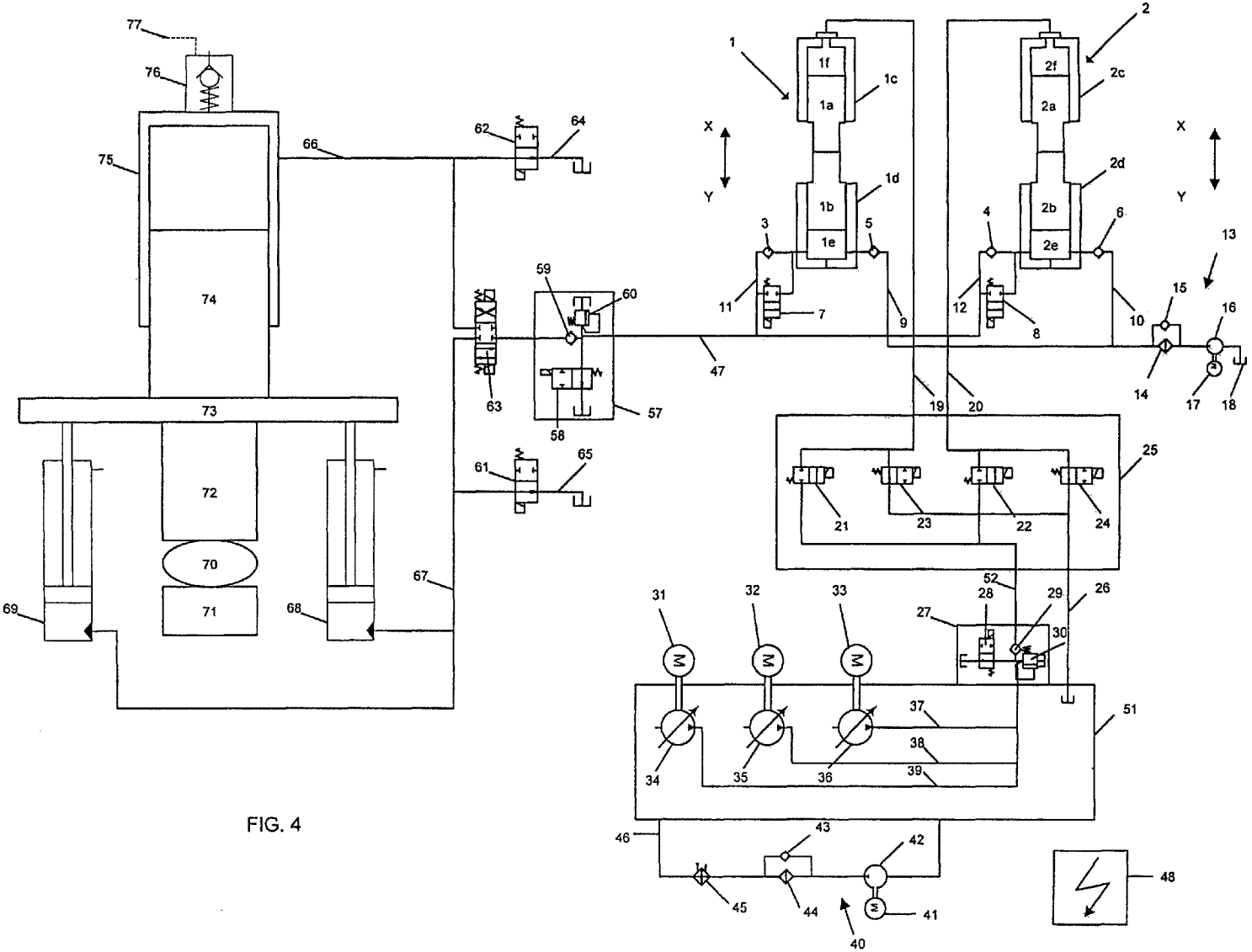
FIG. 4 shows a schematic diagram according to FIG. 1 in connection with a forging press.

Decompression and exhaust valve 61 is connected via pipe to a pressure line 67 to return cylinders 68, 69, which act in the shown embodiment with a piston and piston rods on a main beam 73 of a forging press with main cylinder 75, main ram 74 and forging table 71. Reference 70 is a forged ingot and 76 a prefill and exhaust valve with pressure pilot supply 77. The main cylinder 75 is connected to a pressure line 66, which leads via decompression and exhaust valve 62 and decompression and return line either to suitable container or via distribution valve 63 to pipe 47 so that depending on the position of distribution valve 63 hydraulic liquid under pressure in pipe 47 acts via pressure line 66 on the main ram 74 and presses the forging tool 72 against the forged ingot 70. Instead of a forging press, shown in FIG. 4 another suitable apparatus like a forging hammer or an extrusion machine, or steel working machine, or milling machine or other metal forming machine, could be arranged in a suitable way actuated by the rams 1, 2, respectively.

While a single embodiment of the invention has been shown and described, some changes can be made, especially in view of the number of variable pumps and/or hydrostatic generators or hydrostatic actuators (rams). Therefore various changes may be made in the embodiment shown within the spirit of the invention and the scope of the claims.

LIST OF REFERENCES

1 Generator, Actuator, Ram
1*a* Piston
1*b* Piston
1*c* Cylinder
1*d* Cylinder
1*e* Cylinder room
1*f* Cylinder room
2 Generator, Actuator, Ram
2*a* Piston
2*b* Piston
2*c* Cylinder
2*d* Cylinder
2*e* Cylinder room
2*f* Cylinder room
3 Outlet check valve
4 Outlet check valve
5 Inlet check valve
6 Inlet check valve
7 Precompression valve
8 Precompression valve
9 Pipe, Channel
10 Pipe, Channel
11 Pipe, Channel

12 Pipe, Channel
13 Fluid filtered boost supply
14 Filter element
15 Bypass check valve
16 Pump
17 Motor
18 Fluid or liquid Source, hydraulic source
19 Pipe, Channel
20 Pipe, Channel
21 Admission valve, distribution valve, several way valve
22 Admission valves, distribution valve, several way valve
23 Exhaust valve, distribution valve, several way valve
24 Exhaust valve, distribution valve, several way valve
25 Control manifold
26 Pipe, Channel
27 Loading manifold
28 Valve
29 Check valve
30 Pressure limiter
31 Main motor, motor
32 Main motor, motor
33 Main motor, motor
34 Pump
35 Pump
36 Pump
37 Pipe, Channel, pressure pipe
38 Pipe, Channel, pressure pipe
39 Pipe, Channel, pressure pipe
40 Cooling and filtration loop
41 Motor
42 Pump
43 Bypass check valve
44 Filter element
45 Cooling station
46 Pipe, Channel
47 Pipe, Channel
48 Power supply and automation control cubicles, automation cubicle, cabinet
49 Support frame
50 Auxiliary Motor
51 Hydraulic Reservoir, container
52 Pipe, Channel
53 -
54 -
55 -
56 -
57 Loading manifold
58 Pressure relief valve
59 Check valve
60 Valve
61 Decompression and exhaust valve
62 Decompression and exhaust valve
63 Distribution valve
64 Decompression and return line
65 Decompression and return line
66 Pressure line to main cylinder
67 Pressure line to return cylinders
68 Return cylinder
69 Return cylinder
70 Forged Ingot
71 Forging table
72 Forging tool
73 Main beam
74 Main ram
75 Main cylinder
76 Prefill and exhaust valve
77 Pressure pilot supply X Backward movement of the pistons 1*a*, b, 2*a*, 2*b*
Y Forward movement of the pistons 1*a*, 1*b*, 2*a*, 2*b*

LIST OF LITERATURE

DE 33 26 690 C2
DE 15 02 282
DE 22 23 709

The invention claimed is:

1. Apparatus for actuating processing machines by means of fluid pressurizing media, comprising:

a pumping system comprising at least one motor-driven pump that is variable with regards to flow rate, and a first liquid pressurizing medium reservoir;

at least two alternately driven hydrostatic actuators, each of the at least two hydrostatic actuators comprising a first cylinder having a first cylinder room, a second cylinder having a second cylinder room, a first piston received by the first cylinder room, and a second piston connected to the first piston, the second piston being received by the second cylinder room;

a control manifold comprising at least one distribution valve, the at least one distribution valve configured as a multiple way valve;

a first pipe system connecting the pumping system to the control manifold and connecting the control manifold to the first cylinder room of each of the at least two hydrostatic actuators;

a boost supply comprising a hydraulic fluid source;

a second pipe system connecting the boost supply to the second cylinder room of each of the at least two hydrostatic actuators, the second pipe system configured that a different pressurizing medium from that contained in the first liquid pressurizing medium reservoir can be fed through to the at least two hydrostatic actuators and that the different pressurizing medium is pressurized by the hydrostatic actuators up to the pressure that is needed for actuating the allocated processing machine;

a first outlet check valve;

a second outlet check valve;

a collective pressurizing medium pipe system;

a first pipe connecting the collective pressurizing medium pipe system to the second cylinder room of the first of the at least two hydrostatic actuators by the first outlet check valve;

a second pipe connecting the collective pressurizing medium pipe system to the second cylinder room of the second of the at least two hydrostatic actuators by the second outlet check valve;

a first precompression valve, the first precompression valve configured to bypass the first outlet check valve when operated in order to precompress the second cylinder room of the first of the at least two hydrostatic actuators with a fluid coming from the second pipe through the first precompression valve into the second cylinder of the first of the at least two hydrostatic actuators, when the second piston of the second of the at least two hydrostatic actuators is ready to press a fluid within the second cylinder room of the second of the at least two hydrostatic actuators under high pressure via the second outlet check valve into the second pipe a second precompression valve, the second precompression valve configured to bypass the second outlet check valve when operated in order to precompress the second cylinder room of the second of the at least two hydrostatic actuators with a coming from the first pipe through the second precompression valve into the second cylinder of the second of the at least two hydrostatic actuators, when the second piston of the first of the at least two hydrostatic actuators is ready to press a fluid under high pressure via the first outlet check valve into the first pipe;

whereby the apparatus for actuating processing machines can also operate as a variable pump, pressure or volume control, wherein when flow is not required the first piston and second piston of each of the least two hydrostatic actuators are stationary, and wherein the at least one motor driven pump is configured to actuate the at least two alternately driven hydrostatic actuators through the at least one distribution valve of the control manifold by means of the liquid pressurizing medium from the first liquid pressurizing medium reservoir.

2. Apparatus according to claim 1, characterized in that the pumping system comprising at least one motor-driven pump that is variable with regards to flow rate, the at least one motor-driven pump configured to provide flow rates infinitely variable or adjustable.

3. Apparatus according to claim 1, characterized in that the at least one motor-driven pump that is variable with regard to flow rate comprises at least one check valve through which the fluid pressurizing medium from the first liquid pressurizing medium reservoir is conveyed to the at least one distribution valve of the control manifold.

4. Apparatus according to claim 1, characterized in that the at least two hydrostatic actuators are designed as pressure intensifiers, and wherein the fluid from the hydraulic fluid source of the boost supply is delivered to the second cylinder room of each of the at least two hydrostatic actuators from a common fluid source via a filter element.

5. Apparatus according to claim 1, characterized in that the at least two hydrostatic actuators deliver the fluid from the hydraulic fluid source of the boost supply via a filter element into the collective pressurizing medium pipe system.

6. Apparatus according to claim 1, characterized in that the boost supply further comprises a motor-driven pump, the motor driven pump configured to deliver the hydraulic fluid from the hydraulic fluid source to each of the second cylinder rooms of the at least two hydrostatic actuators, and wherein the fluid within the collective pressurizing medium pipe system comes from the motor-driven pump.

7. Apparatus according to claim 1, characterized in that the first cylinder room and second cylinder room of each of the least two hydrostatic actuators are arranged to each other in a co-axial way, respectively.

8. Apparatus according to claim 7, characterized in that in the cylinder rooms that are arranged in a co-axial way towards each other within the hydrostatic actuators, pistons are arranged with equal or different pressure active piston areas and that can be moved longitudinally and back and forth alternately.

9. Apparatus according to claim 7, characterized in that the first piston received by the first cylinder room of the first hydrostatic actuator of the at least two hydrostatic actuators comprises a pressure active piston area, and the second piston received by the second cylinder room of the first hydrostatic actuator of the at least two hydrostatic actuators comprises a pressure active piston area, wherein the pressure active piston area of the second piston of the first hydrostatic actuator of the at least two hydrostatic actuators is 10 % to 45 % of the piston active area of the first piston of the first hydrostatic actuator of the at least two hydrostatic actuators.

10. Apparatus according to claim 1, characterized in that the each of the at least two hydrostatic actuators comprises a longitudinal axis, wherein the longitudinal axis of the first of the at least two hydrostatic actuators is arranged parallel to the longitudinal axis of the second of the at least two hydrostatic actuators and in vertical planes.

11. Apparatus according to claim 1, characterized in that each rim stroke is between 0.5 meters and three meters.

12. Apparatus according to claim 1, characterized in that the second pipe system further comprises a first inlet check valve connecting the second cylinder room of the first hydrostatic actuator of the at least two hydrostatic actuators to the second pipe system, and a second inlet check valve connecting the second cylinder room of the second hydrostatic actuator of the at least two hydrostatic actuators to the second pipe system, and wherein the full cycle time is between four to twenty seconds, with between two to ten seconds to pump, between one to nine seconds to return, 0.5 seconds to close the first and second inlet check valve, and 0.5 seconds to precompress the fluid from the hydraulic fluid source of the boost supply.

13. Apparatus according to claim 1, characterized in that the speed of the first piston of the first hydrostatic actuator of the at least two hydrostatic actuators during its pumping and returning stroke is constant, except for the short acceleration and deceleration period, and has values respectively between 100 mm/sec to 500 mm/sec for pumping and between 130 mm/sec to 700 mm/sec for returning.

14. Apparatus according to claim 1, characterized in that the second pipe system further comprises a first inlet check valve connecting the second cylinder room of the first hydrostatic actuator of the at least two hydrostatic actuators to the second pipe system, and a second inlet check valve connecting the second cylinder room of the second hydrostatic actuator of the at least two hydrostatic actuators to the second pipe system, and wherein the at least two hydrostatic actuators creates between 4 cycles to 12 cycles per minute and each the first outlet check valve, the second outlet check valve, the first inlet check valve and second inlet check valve operate between 4 times to 12 times per minute.

15. Apparatus according to claim 1, characterized in that the hydraulic fluid source of the boost supply contains a fluid selected from the group consisting of high water based fluids and pure water, and that the first cylinder room of the first of the at least two hydrostatic actuators and the first cylinder room of the second of the at least two hydrostatic actuators receive a fluid different than the fluid contained within the hydraulic fluid source of the boost supply.

16. Apparatus according to claim 1, characterized in that the apparatus is built by modules of components.

17. Apparatus for actuating processing machines by means of fluid pressurizing media, comprising:

a pumping system comprising at least one motor-driven pump that is variable with regard to flow rate, and a first liquid pressurizing medium reservoir;

at least two alternately driven hydrostatic actuators, each of the at least two hydrostatic actuators comprising a fist cylinder having a first cylinder room, a second cylinder having a second cylinder room, a first piston received by the first cylinder room, and a second piston received by the second cylinder room;

a control manifold comprising at least one distribution valve, the at least one distribution valve configured as a multiple way valve;

a first pipe system connecting the pumping system to the control manifold and connecting the control manifold to the first cylinder room of each of the at least two hydrostatic actuators;

a boost supply comprising a hydraulic fluid source;

a second pipe system comprising a first inlet check valve connecting the second cylinder room of the first hydrostatic actuator of the at least two hydrostatic actuators to the boost supply, and a second inlet check valve connecting the second cylinder room of the second hydrostatic actuator of the at least two hydrostatic actuators to the boost supply, the second pipe system configured that a different pressurizing medium from that contained in the first liquid pressurizing medium reservoir can be fed through to the at least two hydrostatic actuators and that the different pressurizing medium is pressurized by the hydrostatic actuators up to the pressure that is needed for actuating at least one allocated processing machine;

a first outlet check valve;

a second outlet check valve;

a collective pressurizing medium pipe system;

a first pipe connecting the collective pressurizing medium pipe system to the second cylinder room of the first of the at least two actuators by the outlet check valve;

a second pipe connecting the collective pressurizing medium pipe system to the second cylinder room of the second of the at least two hydrostatic actuators by the second outlet check valve;

a first precompression valve in the second cylinder room of the first of the least two hydrostatic actuators, the first precompression valve configured to deliver a fluid from the second pipe into the second cylinder room of the first of the at least two hydrostatic actuators when the second piston of the second of the at least two hydrostatic actuators is in its lowermost position, when the first piston of the first hydrostatic actuator of the at least two hydrostatic actuators is in its uppermost position, when the second cylinder room of the first hydrostatic actuator of the at least two hydrostatic actuators is in its precompression position, and when the second piston of the second hydrostatic actuator of the at least two hydrostatic actuators delivers high pressure by starting its movement; and a second precompression valve in the second cylinder room of the second of the least two hydrostatic actuators, the second precompression valve configured to deliver a fluid from the first pipe into the second cylinder room of the second of the at least two hydrostatic actuators when the second piston of the first of the at least two hydrostatic actuators is in its lowermost position, when the first piston of the second hydrostatic actuator of the at least two hydrostatic actuators is in its uppermost position, when the second cylinder room of the second hydrostatic actuator of the at least two hydrostatic actuators is in its precompression position, and when the second piston of the first hydrostatic actuator of the at least two hydrostatic actuators delivers high pressure by starting its movement;

wherein when the second piston of the second hydrostatic actuator of the at least two actuators after starting its movement the second cylinder room of the first hydrostatic actuator of the at least two hydrostatic actuators is filled with a fluid through the first inlet check valve and the second piston of the second hydrostatic actuator of the at least two hydrostatic actuators delivers a fluid under high pressure into the collective pressurizing medium pipe system by movement of that piston in its down position through the second outlet check valve, wherein when the first inlet check valve is closed from the second cylinder room of the second hydrostatic actuator of the at least two hydrostatic actuators a fluid under high pressure is delivered into the collective pressurizing medium pipe system through the second outlet check valve, wherein when the second piston of the second hydrostatic actuator of the at least two hydrostatic actuators is in its down position the second cylinder room of the first hydrostatic actuator of the at least two hydrostatic is in its precompression position, in which fluid coming from the first pipe connecting the collective pressurizing medium pipe system to the second cylinder room of the first of the at least two hydrostatic actuators is delivered through the first precompression valve in the second cylinder room of the first hydrostatic actuator of the at least two hydrostatic actuators, wherein when the second cylinder room of the first hydrostatic actuator of the at least two hydrostatic actuators delivers fluid under high pressure via the first outlet check valve into the collective pressurizing medium pipe system and second piston of the second hydrostatic actuator of the at least two hydrostatic actuators moving by prefilling with fluid, the second cylinder room of the first of the at least two hydrostatic actuators delivers fluid via the first outlet check valve into the collective pressurizing medium pipe system under high pressure, wherein when the first inlet check valve is closing and the second piston of the second hydrostatic actuator of the at least two hydrostatic actuators is moved completely in one direction and the second piston of the first hydrostatic actuator of the at least two hydrostatic actuators is completely in the other direction and the second cylinder room of the second hydrostatic actuator of the at least two hydrostatic actuators is precompressed by opening of the second precompression valve and the second piston of the second hydrostatic actuator of the at least two hydrostatic actuators is ready to press a fluid under high pressure via the second outlet check valve into the collective pressurizing medium pipe system, and wherein the apparatus for actuating processing machines can also operate as a variable pump, pressure or volume control, wherein when flow is not required the first piston and second piston of each of the least two hydrostatic actuators are stationary.

18. Method for actuating processing machines by means of fluid pressurizing media, with an apparatus having at least one motor-driven pump that is variable with regard to its flow rate, and can operate as a variable pump, pressure or volume control and when flow is not required the actuators are stationary, comprising:

alternatively actuating at least two alternately driven hydrostatic actuators through at least one distribution valve by means of a first liquid pressurizing medium, wherein the at least one distribution valve is designed as a multiple way valve and arranged as a distribution valve in a collective housing thereby providing a control manifold;

feeding through a separated pipe system to the at least two hydrostatic actuators a second pressurizing medium, a second pressurizing medium different than the first pressurizing medium;

pressurizing with the first hydrostatic actuator of the at least two hydrostatic actuators the second pressurizing medium fed through the separated pipe system to the at least two hydrostatic actuators, wherein the second pressurizing medium is pressurized by the first hydrostatic actuator of the least two hydrostatic actuators up to a pressure needed for actuating the processing machine;

actuating the processing machine by delivering to the processing machine via a collective pressurizing medium pipe system the second pressurizing medium pressurized by the first of the at least two hydrostatic actuators;

precompressing a cylinder room of the second hydrostatic actuator of the at least two hydrostatic actuators with the pressurized second pressurizing medium from the collective pressurizing medium pipe system via a precompression valve, wherein the pressurized second pressurizing medium form the collective pressurizing medium pipe system bypasses a check valve when a piston of the first hydrostatic actuator of the at least two hydrostatic actuators is ready to press the pressurized second pressurizing medium under high pressure via a check valve to the processing machine via the collective pressurizing medium pipe system.

19. Control for an apparatus actuating processing machines by means of fluid pressurizing media, comprising:

a pumping system comprising at least one motor-driven pump that is variable with regard to flow rate, and a first liquid pressurizing medium reservoir;

at least two alternately driven hydrostatic actuators;

a control manifold comprising at least one distribution valve, the at least one distribution valve configured as a multiple way valve;

a first pipe system connecting the pumping system to the control manifold and connecting the control manifold to a first cylinder room in each of the at least two hydrostatic actuators;

a boost supply comprising a hydraulic fluid source;

a second pipe system connecting the boost supply to a second cylinder room of each of the at least two hydrostatic actuators, the second pipe system configured that a different pressurizing medium from that contained in the first liquid pressurizing medium reservoir can be fed to the at least two hydrostatic actuators and that the different pressurizing medium is pressurized by the hydrostatic actuators up to the pressure that is needed for actuating the allocated processing machine;

a first outlet check valve;

a second outlet check valve;

a collective pressurizing medium pipe system;

a first pipe connecting the collective pressurizing medium pipe system to the second cylinder room of the first of the at least two hydrostatic actuators by the first outlet check valve;

a second pipe connecting the collective pressurizing medium pipe system to the second cylinder room of the second of the at least two hydrostatic actuators by the second outlet check valve;

a first precompression valve, the first precompression valve configured to bypass the first outlet check valve, when operated in order to precompress the second cylinder room of the first of the at least two hydrostatic actuators with a fluid coming from the second pipe through the first precompression valve into the second cylinder room of the first of the at least two hydrostatic actuators when a piston of the second of the at least two hydrostatic actuators is ready to press a fluid under high pressure via the second outlet check valve into the collective pressurizing medium pipe system; and a second precompression valve, the second precompression valve configured to bypass the second outlet check valve, when operated in order to precompress the second cylinder room of the second of the at least two hydrostatic actuators with a fluid coming from the first pipe through the second precompression valve into the second cylinder room of the second of the at least two hydrostatic actuators when a piston of the first of the at least two hydrostatic actuators is ready to press a fluid under high pressure via the first outlet check valve into the collective pressurizing medium pipe system, whereby the apparatus for actuating processing machines can also operate as a variable pump, pressure or volume control, and wherein when flow is not required the actuators are stationary.

20. Control of an apparatus according to claim 19, characterized in that the at least two hydrostatic actuators deliver fluid under pressure between 200 and 450 bar.

21. Control of an apparatus according to claim 19, characterized in that the at least two hydrostatic actuators deliver a liquid under a pressure between 200 and 1400 bar.

22. Control of an apparatus according to claim 19, characterized in that the flow rate delivered and/or the pressure is controlled by the working status of the driven forging machine, forging press or extrusion machine.

* * * * *